United States Patent [19]

Herriman

[11] 4,019,741

[45] Apr. 26, 1977

[54] GAME WITH MECHANICAL CAPTURE MEANS

[76] Inventor: Straud D. Herriman, 229 Kentucky Ave., Danville, Ill. 61832

[22] Filed: Dec. 5, 1975

[21] Appl. No.: 638,050

[52] U.S. Cl. ..... 273/131 BA

[51] Int. Cl.[2] ..... A63F 3/00

[58] Field of Search ..... 273/130, 131, 134

[56] References Cited

UNITED STATES PATENTS

| | | | |
|---|---|---|---|
| 1,295,436 | 2/1919 | Cogswell | 273/131 BA |
| 3,169,768 | 2/1965 | Glass et al. | 273/134 A |
| 3,913,920 | 10/1975 | Brummit | 273/134 GM |

FOREIGN PATENTS OR APPLICATIONS

| | | | |
|---|---|---|---|
| 335 | 1/1907 | United Kingdom | 273/131 BA |

*Primary Examiner*—Delbert B. Lowe
*Attorney, Agent, or Firm*—David V. Munnis

[57] ABSTRACT

Game of the peg-board-type having levered means for ejecting playing piece dowels from predetermined playing surface holes upon the insertion of another playing piece in another predetermined hole of play.

6 Claims, 5 Drawing Figures

GAME WITH MECHANICAL CAPTURE MEANS

BACKGROUND OF THE INVENTION

This invention relates to a game of the peg-board-type and more particularly to an improved game of such type having a novel and interest-promoting means for one player to eject or "trap" playing pieces of another player.

Games of the peg-board-type are available of widely differing designs and construction. Popularity of such games stems, in good part, from the ability of the peg-boards to be played with under almost any conditions of vibration, such as in moving vehicles, on relatively unstable supports, and/or involving over-active young players, and, due to the use of retaining dowels on the bottom of the playing pieces, maintain the playing pieces of the game in place.

While many designs of such games have been proposed, it is a feature of games in general that, with time, their attractiveness diminishes as a means of recreation and the search in the art continues for new modifications offering unique entertainment.

OBJECTS OF THE INVENTION

Accordingly, it is the primary object of this present invention to provide a novel game.

It is a particular object of the present invention to provide an improved game of the peg-board-type which is simple to play, has an extra exciting feature for opponent playing piece capture, and advantageously offers an attractive means of entertainment for persons of all ages.

DESCRIPTION OF DRAWINGS

The present invention will be more readily understood from the following detailed description thereof given with reference to the attached drawings of which.

DESCRIPTION OF SPECIFIC EMBODIMENTS

Figure 1:
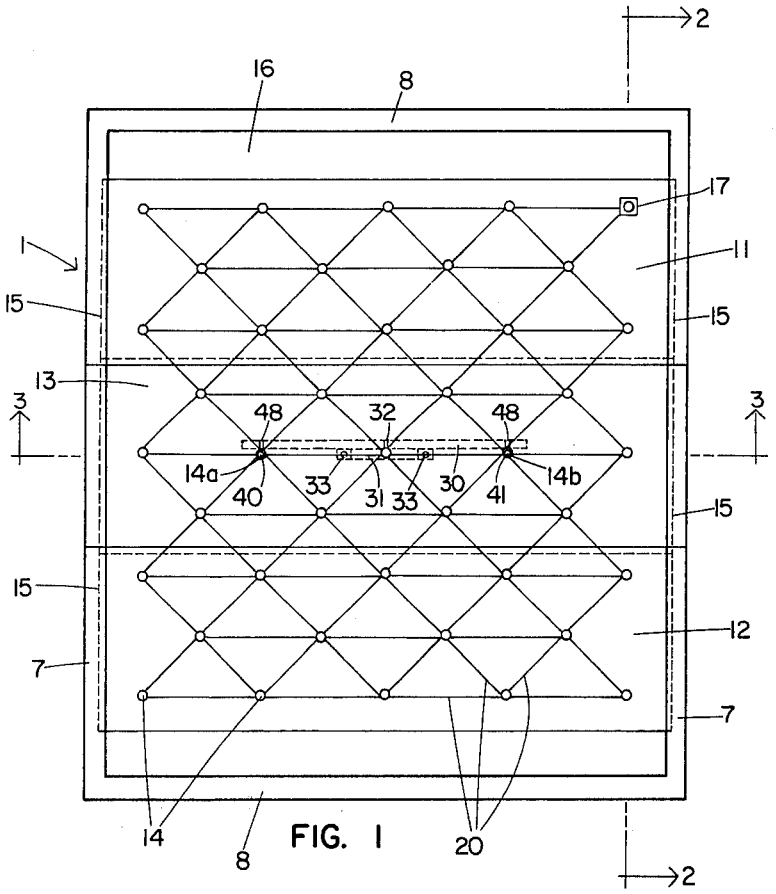
FIG. 1 is a top view of an embodiment of the playing board of the game of the present invention.
Figure 2:
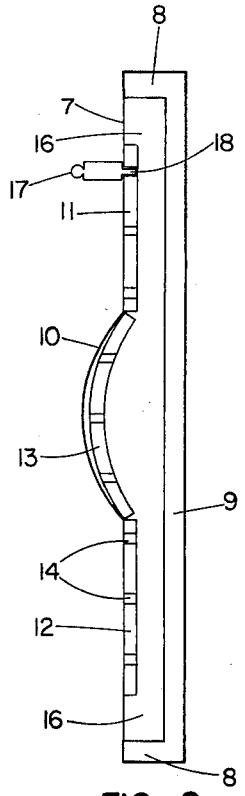
FIG. 2 is a side sectional view of the board of FIG. 1, taken along line 2—2.
Figure 3:
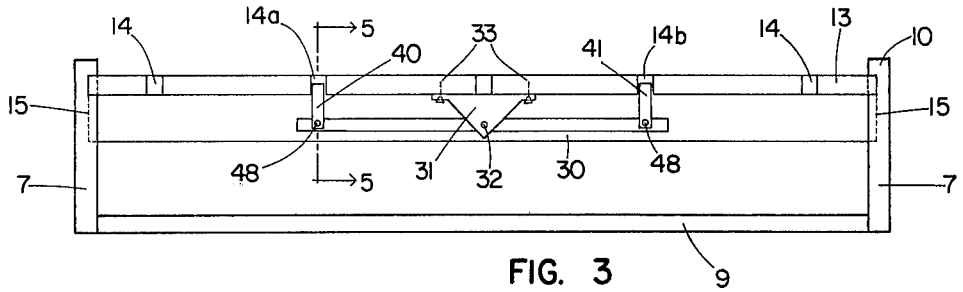
FIG. 3 is an enlarged front sectional view of the board of FIG. 1, taken along line 3—3.

Broadly described, the present invention provides a peg-board-type game comprising a peg-board playing surface having a plurality of spaced vertical holes therein adapted to receive and retain dowels positioned on the bottom of manually movable playing pieces for said game, a frame for supporting said playing surface, said playing surface being divided into at least three components, two of said playing surface components being spaced laterally apart and being essentially horizontal, and the third of said playing surface components being positioned between said two horizontal components and having an upper surface which traverses the space between and rises above the upper surface of said two horizontal playing surface components, means positioned below said third playing surface component for ejecting the dowels of playing pieces from predetermined holes in said third playing surface component, said dowel ejecting means comprising a lever pivoted between the ends thereof and having, positioned on opposite sides of said pivot, two peg elements, each of said peg elements being adapted for essentially vertical movement upwardly into and downwardly out of one of a pair of said predetermined holes upon a pivoting movement of said lever, so that when a dowel of a first playing piece is located in either of said pair of predetermined holes, said first piece dowel is adapted to be ejected therefrom by the respective peg element adjacent thereto upon a dowel of a second playing piece being inserted into the other of said pair of predetermined holes and causing thereby said lever to pivot. With reference to FIGS. 1–5, numeral 1 designates generally a playing board. Board 1 has a playing surface containing a plurality of spaced vertical holes 14 and has, inscribed on the upper face thereof by printing, grooving, and the like, lines 20, connecting holes 14, indicating possible directions of play. The playing surface of board 1 comprises two laterally spaced apart and essentially horizontal playing surface components 11 and 12 and a third playing surface component 13, located between components 11 and 12, which has an upper surface which rises above the surface of playing surface components 11 and 12. In the more preferred embodiments of the game of the present invention, the surface of component 13 is generated by a line which traverses the space between horizontal components 11 and 12 along a path which first rises and then falls. In the embodiment shown, intermediate playing surface component 13 is a segment of a cylinder which has bee bifurcated (i.e., divided into two parts) by a plane parallel to the axis of the cylinder.

In board 1 playing surface components 11, 12 and 13 are mounted in a frame, having a bottom 9, sidewalls 7, and endwalls 8, within which components 11, 12, and 13 are supported by suitable means, such as within slots 15 provided on the inner surface of sidewalls 7. Preferably, the ends of surface components 11 and 12 terminate at a point which is removed from the inside surface of end walls 8 to provide therebetween pocket areas 16 in which playing pieces not in use in the game may be placed and stored.

In accordance with the present invention, holes 14 provided in the surface of board 1 all are adapted to receive and retain dowels 18 positioned on the bottom of playing pieces 17. The particular horizontal cross-sectional area of holes 14 and dowels 18 is not critical and suitable may be arcuate, square, rectangular, diamond-shaped, and the like, but preferably, as shown, is circular.

In accordance with the game of the present invention, means are provided which are positioned beneath the playing surface for ejecting and "capturing" an opponent's playing pieces from predetermined holes 14. The ejection means comprises at least one lever, pivoted intermediate its ends, and having positioned on opposite sides of the pivot peg elements which are so positioned and shaped as to be adapted for reciprocative movement vertically upwardly into and downwardly out of predetermined holes of board 1 upon the movement of the lever. In the embodiment shown the playing piece ejection means comprises lever element 30 which is pivotally connected beneath and longitudinally of playing surface component 13 by pin 32 mounted horizontally in bracket 31, which in turn is mounted to the underside of playing surface component 13 by suitable means, such as screws 33.

A pair of peg elements 40 and 41 are positioned on lever 30 on opposite sides of the pivot pin 32 and are positioned to be adapted for essentially vertical movement upwardly into and downwardly out of holes 14*a* and 14*b*, respectively, adjacent thereto. In practice, peg elements 40 and 41 suitably may be fixedly attached to lever 30. In such instances the horizontal cross-sectional areas of peg elements 40 and 41 would be smaller than those of ejection holes 14*a* and 14*b*, and peg elements 40 and 41 would be removed from pivot 32 to a sufficient lateral distance to allow clearance in holes 14*a* and 14*b* for their desired vertical reciprocative movement when lever 30 is moved.

Figure 5:
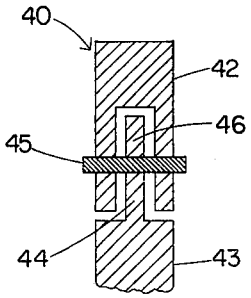
FIG. 5 is a side sectional view, partially broken away, of an embodiment of playing piece ejection element shown in FIG. 3, taken along line 5—5.
Figure 4:
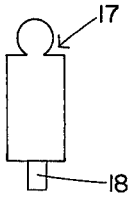
FIG. 4 is a diagramatic side view of a dowel-bearing playing piece adapted for use in the game of the present invention.

In the more preferred embodiments of the game of the present invention, the playing piece ejection means comprising lever 30 and peg elements 40 and 41 is further provided with means to promote vertical movement of peg elements 40 and 41 along the axes of holes 14*a* and 14*b*, respectively, when they are caused to reciprocate vertically by a movement of lever 30. In such preferred embodiments, peg elements 40 and 41 are hingedly connected to lever 30 such as by pins 48, with hinges 48 having an axis parallel to that of pivot 32. Further vertical promotion means for elements 40 and 41 also may be provided, such, as is shown in FIG. 5, as by one or both of peg elements 40 and 41 being divided into spacedupper and lower sections 42 and 43 which are pivotally connected such as by a pin 45 having an axis parallel to that of pivot 32. Additional suitable peg element vertical movement promotion means, not shown, include a small horizontal slot in lever 30 at pivot connection 32 and bevels on the tops of pins 40 and 41 where same contact the inside surfaces of holes 14*a* and 14*b* removed from pivot 32.

In use, playing pieces 17 are located and moved across the playing surface of board 1 by the players manually, in sequence, inserting the dowels 18 thereof into holes 14. When a player places the dowel 18 of his piece 17 into hole 14*a*, for example, the dowel contacts and depresses peg 40. The so located playing piece 17 in hole 14*a* could then be captured by another player moving his piece 17 into the hole 14*b*, whereby the dowel 18 of the latter playing piece contacts and depresses peg 41, thereby causing lever 30 to rotate about pivot 32 and peg 40 to rise upwardly into hole 14a and displace or "capture" the piece 17 from hole 14a.

I claim:

1. A peg-board type game composing a peg-board playing surface having a plurality of spaced vertical holes therein adapted to receive and retain dowels positioned on the bottom of manually movable playing pieces for said game, a frame for supporting said playing surface, said playing surface being divided into at least three components, two of said playing surface components being spaced laterally apart and being essentially horizontal, and the third of said playing surface components being positioned between said two horizontal components and having an upper surface which traverses the space between and rises above the upper surface of said two horizontal playing surfacecomponents, means positioned below said third playing surface component for ejecting the dowels of playing pieces from predetermined holes in said third playing surface component, said dowel ejecting means comprising a lever pivoted between the ends thereof and having, positioned on opposite sides of said pivot, two peg elements, each of said peg elements being adapted for essentially vertical movement upwardly into and downwardly out of one of a pair of said predetermined holes upon a pivoting movement of said lever, so that a dowel of a first playing piece is adapted to be ejected from one of a pair of said predetermined holes by the respective peg element adjacent thereto, upon a dowel of a second playing piece being inserted into the other of said pair of predetermined holes and causing thereby said lever to pivot.

2. The game according to claim 1 wherein said third playing surface component has an upper surface generated by a horizontal line traversing the space between said horizontal playing surface components along a path which travels first upwardly and then downwardly.

3. The game according to claim 2 wherein said third playing surface component is a segment of a cylinder.

4. The game according to claim 3 wherein said lever of said playing piece ejecting means is positioned longitudinally of said third playing surface component.

5. The game according to claim 1 wherein said peg elements are hingedly attached to said lever and said dowel ejecting means includes means to promote upward vertical movement of said peg elements along a path parallel to the axes of said predetermined holes.

6. The game according to claim 5 wherein said vertical movement promotion means for said peg elements includes said peg elements being divided into at least two vertical body sections connected together by hinge means, having an axis parallel to the axis of said pivot of said lever.

* * * * *